US007980573B1

(12) United States Patent
Naman

(10) Patent No.: US 7,980,573 B1
(45) Date of Patent: Jul. 19, 2011

(54) SPRING BOARD

(76) Inventor: Faris Naman, Sylmar, CA (US)

( * ) Notice: Subject to any disclaimer, the term of this patent is extended or adjusted under 35 U.S.C. 154(b) by 494 days.

(21) Appl. No.: 12/220,590

(22) Filed: Jul. 25, 2008

Related U.S. Application Data

(63) Continuation-in-part of application No. 11/821,037, filed on Jun. 21, 2007, now abandoned, which is a continuation-in-part of application No. 11/101,020, filed on Apr. 6, 2005, now abandoned.

(51) Int. Cl.
*B62M 1/00* (2010.01)

(52) U.S. Cl. ..... 280/87.041; 280/254

(58) Field of Classification Search ..... 280/87.01, 280/87.021, 87.041, 87.042, 842, 253, 254, 280/11.115
See application file for complete search history.

(56) References Cited

U.S. PATENT DOCUMENTS

| | | | | |
|---|---|---|---|---|
| 936,173 | A * | 10/1909 | Schoenberg | 280/11.115 |
| 1,782,078 | A * | 11/1930 | Stiver | 280/11.115 |
| 1,867,687 | A * | 7/1932 | Van Etten | 74/130 |
| 4,069,881 | A | 1/1978 | Shiber | |
| 4,155,565 | A | 5/1979 | de Caussin et al. | |
| 4,451,055 | A * | 5/1984 | Lee | 280/221 |
| 5,002,294 | A | 3/1991 | Franz | |
| 5,127,488 | A | 7/1992 | Shanahan | |
| 5,224,719 | A * | 7/1993 | Goodspeed | 280/11.115 |
| 5,263,725 | A | 11/1993 | Gesmer et al. | |
| 5,280,935 | A * | 1/1994 | Sobocan | 280/221 |
| 5,540,455 | A | 7/1996 | Chambers | |
| 5,839,737 | A * | 11/1998 | Kruczek | 280/11.115 |
| 6,079,724 | A * | 6/2000 | Lin | 280/221 |
| 6,286,907 | B1 | 9/2001 | Meader | |
| 6,558,265 | B1 | 5/2003 | Middleton | |
| 6,588,784 | B1 * | 7/2003 | Chen | 280/221 |
| 6,616,163 | B2 | 9/2003 | Lee | |
| 6,698,776 | B2 | 3/2004 | Todd | |

FOREIGN PATENT DOCUMENTS

| | | |
|---|---|---|
| EP | 0 557 872 A1 | 2/1993 |
| WO | WO 97/28863 | 8/1997 |

* cited by examiner

*Primary Examiner* — Frank Vanaman
(74) *Attorney, Agent, or Firm* — Emery L. Tracy

(57) ABSTRACT

A skateboard having extra sets of gears compared to a regular skateboard and also has a lower support platform is provided. When an individual jumps on the skateboard, the support platform and extra gears cause the skateboard to automatically travel forward due to the interaction between the support platform, the extra gears, and the existing wheels on the skateboard.

2 Claims, 1 Drawing Sheet

SPRING BOARD

The present application is a continuation-in-part of pending patent application Ser. No. 11/821,037, filed on Jun. 21, 2007, which is a continuation-in-part of patent application Ser. No. 11/101,020, filed on Apr. 6, 2005, now abandoned.

BACKGROUND OF THE INVENTION

1. Field of the Invention

This invention relates generally to a skateboard and, more particularly, the invention relates to a skateboard which automatically travels in a forward direction when an individual jumps and/or bounces on the skateboard.

2. Description of the Prior Art

U.S. Pat. No. 6,698,776 B2, issued to Todd, discloses a skateboard for use on a hard surface, with the skateboard being configured to simulate the response of a snowboard.

U.S. Pat. No. 6,616,163 B2, issued to Lee, discloses a combined skateboard scooter/exerciser which comprises a handlebar, a board, a steering device, a transmission device, and a wheel drive.

SUMMARY

The present invention concerns that of a new and improved skateboard. The skateboard has extra sets of gears compared to a regular skateboard and also has a lower support platform. When an individual jumps on the skateboard, the support platform and extra gears cause the skateboard to automatically travel forward due to the interaction between the support platform, the extra gears, and the existing wheels on the skateboard.

There has thus been outlined, rather broadly, the more important features of a skateboard that the detailed description thereof that follows may be better understood and in order that the present contribution to the art may be better appreciated. There are, of course, additional features of the skateboard that will be described hereinafter and which will form the subject matter of the claims appended hereto.

In this respect, before explaining at least one embodiment of the skateboard in detail, it is to be understood that the skateboard is not limited in its application to the details of construction and to the arrangements of the components set forth in the following description or illustrated in the drawings. The skateboard is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present skateboard. It is important, therefore, that the claims be regarded as including such equivalent constructions insofar as they do not depart from the spirit and scope of the present invention.

It is therefore an object of the present invention to provide a skateboard which has all of the advantages of the prior art and none of the disadvantages.

It is another object of the present invention to provide a skateboard which may be easily and efficiently manufactured and marketed.

It is another object of the present invention to provide a skateboard which is of durable and reliable construction.

It is yet another object of the present invention to provide a skateboard which is economically affordable and available for relevant market segment of the purchasing public.

Other objects, features and advantages of the present invention will become more readily apparent from the following detailed description of the preferred embodiment when considered with the attached drawings and appended claims.

DETAILED DESCRIPTION OF THE PREFERRED EMBODIMENTS

Figure 1:
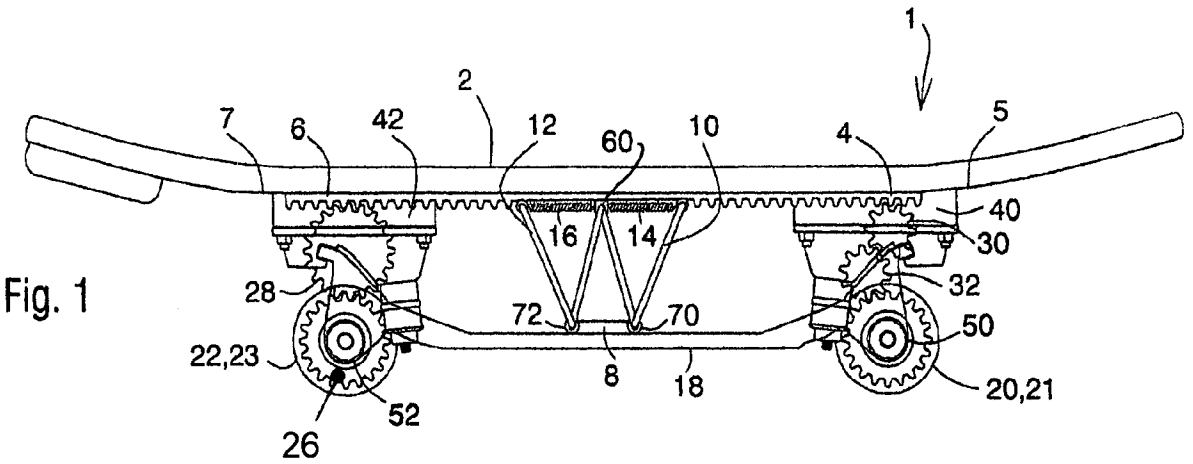
FIG. 1 is an elevational side view illustrating a spring board, constructed in accordance with the present invention, prior to having any weight placed downward upon the main board.
Figure 2:
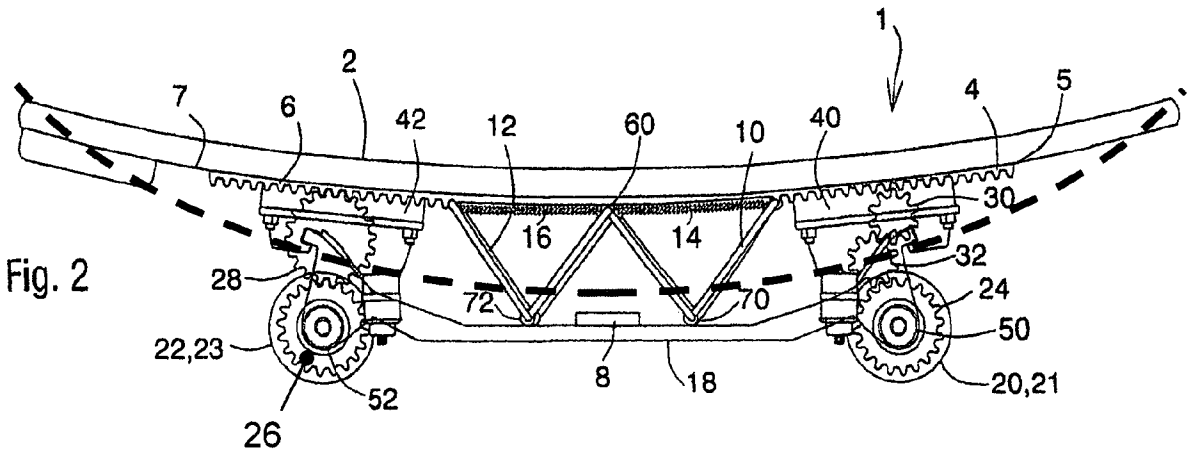
FIG. 2 is an elevational side view of the spring board, constructed in accordance with the present invention, after weight is placed downward upon the main board.

FIG. 1 shows a side view of the skateboard 1 prior to having any weight placed downward upon the main board 2, while FIG. 2 shows a side view of the skateboard 1 after weight is placed downward upon the main board 2. The present invention is a skateboard that allows an individual to merely jump on the center of the main board, which starts a rapid chain of events that causes the skateboard 1 itself to automatically move forward.

Main board 2 has two surfaces, a top surface and a bottom surface, with the top surface designed to be a standing platform for an individual. Main board 2 also has two ends, a front end and a rear end. Main board 2 is fabricated from a substance that has mild flexibility once weight is pushed downward onto it. Main board 2 is preferably flat in the middle, with the board curving upward slightly once it gets near either the front end or the rear end of the main board 2. This configuration gives the board a slight concave configuration in relation to the top surface of the main board 2 and a slight convex configuration in relation to the bottom surface of the main board 2.

The bottom surface of the main board 2 has a front set of teeth 4 and a rear set of teeth 6. The front set of teeth 4 is located on a first track 5, while the rear set of teeth 6 are located on a second track 7. Each of the sets of teeth has two ends, a first end and a second end, with the first end of each set of teeth being located closest to the middle of the main board 2 and the second end of each set of teeth being located nearest the end of the main board 2.

Attached to the bottom surface of the main board 2 are front bracket 40 and a rear bracket 42. The front bracket 40 is attached to the main board 2 near the front end of the main board, while the rear bracket 42 is attached to the main board 2 near the rear end of the main board 2. Attached to the front bracket 40 are front wheels 20 and 21, while attached to the rear bracket 42 are rear wheels 22 and 23. The brackets 40 and 42 provide the structural framework to hold up the wheels and remaining components of the skateboard 1. Front wheels 20 and 21 are connected by an axle 50, while rear wheels 22 and 23 are connected by an axle 52.

Underneath the main board 2 is located a rigid lower support bar 18, which has two ends, a front end and a rear end, and two surfaces, a top surface and a bottom surface. The front end of the lower support bar 18 is attached to the front bracket 40, while the rear end of the lower support bar 18 is attached to the rear bracket 42. On the top surface of the lower support bar 18 is located a support stopper block 8 that is located exactly halfway in between the front end and the rear end of the lower support bar 18.

Located in between the main board 2 and the lower support bar 18 are front V-frame 10 and rear V-frame 12, which each have two ends, a first end and a second end. The first end of both V-frames is connected to a central bracket 60 located on the bottom surface of the main board 2. The second end of the front V-frame 10 is fixedly attached to the first end of the front set of teeth 4, while the second end of the rear V-frame 12 is fixedly attached to the first end of the rear set of teeth 6.

Front V-frame 10 has a roller wheel 70 attached to it halfway in between the first end and second end of the front V-frame 10, while rear V-frame 12 has a roller wheel 72 attached to it halfway in between the first end and second end of the front V-frame 12. When pressure is placed downward upon the main board 2, then the roller wheels will travel outward away from the stopper block 8. When no pressure is being placed against the main board 2, the roller wheels 70 and 72 are resting against the stopper block 8 due to the force of springs 14 and 16.

Attached to the first end and the second end of front V-frame 10 is a front spring 14, while attached to the first end and the second end of rear V-frame 12 is a rear spring 16. These springs are normally positioned when the main board 2 has no downward pressure applied to it, and begin to stretch out once the individual starts putting downward pressure (bouncing) on the middle part of the skateboard main board 2 which will lead to the first end and second end of each of the V-frames pull apart. The springs act to pull the two ends of each V-frame back together once no more downward pressure is being placed upon the main board 2.

The skateboard 1 also has a plurality of other gears that are in use to propel the skateboard 1 forward. Acting in concert with the front wheels 20 and 21 are a front lower support gear 32 and a front upper support gear 30. Front-toothed gear 24 is axially mounted around the axle 50, with the gear 24 being located adjacent to one wheel of the front wheels 20 and 21. The front-toothed gear 24 is connected to the front lower support gear 32, which is connected to the front upper support gear 30. The front upper support gear 30, in turn, is directly in contact with the front set of teeth 4 located on the underside of the main board 2 of the skateboard 1.

At the same time, acting in concert with the rear wheels 22 and 23 is rear upper toothed gear 28. Rear-toothed gear 26 is axially mounted around the axle 52, with the gear 26 being located adjacent to one wheel of the rear wheels 22 and 23. The rear-toothed gear 26 is connected to the rear upper toothed gear 28. The rear upper toothed gear 28, in turn, is directly in contact with the rear set of teeth 6 located on the underside of the main board 2 of the skateboard 1.

When an individual jumps or puts pressure on the center of top surface of the main board 2 by his or her feet to the center of the main board 2, the main board 2 will bend downward reducing the distance between the main board 2 and the support bar 18 forcing the front V-frame 10 and the rear V-frame 12 to lower in height, pushing apart the second end of each V-frame outwards while the first end will be fixed to the central bracket 60. This motion expands the levers 10 and 12 that are connected to the gear teeth 4 and 6 actuating one-way ball bearings in all of support gears 30, 32 and 24 which is connected to the axle 50 that will propel wheels 20 and 21 forward. The gear teeth 4 and 6 are only engaged by pushing down in the middle of the main board 2.

Rear wheels 52 are connected to one set of gears 28 that hook to the long teethed gears 6 while the front wheels 50 are connected to the long teethed gears 4 through two gears 30 and 32, assuring that both one way bearings/wheels 20, 21, 22, and 23 are moving towards the front (one direction) when the bouncing action take place. With the bouncing up and down motion the springboard is unidirectional board. Coasting occurs when the board 2 is in its initial position, i.e., prior to pushing down. Without using this movement to propel the board, the board can free-wheel coast and is movable in both directions. This board is NOT steerable like a normal skateboard when the board is in its initial position or movement since we have to keep all axes in line for propulsion all the time.

Due to the fact that there are gears that must be aligned all the time in this skateboard, the skateboard of the present invention can be steered only by the individual using his/her two feet in such a manner: placing second foot to the rear end of the main board 2 and first foot on the center of main board 2 in such a manner while propelling the skateboard he/she can exert some pressure using the second foot to the rear end of the skateboard which will help reducing the pressure on the front end wheels which will help steering the skateboard left or right using the first foot. This movement is used by all skateboard players to direct the normal skateboards as well.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A skateboard comprising:

a main board having a top surface, a bottom surface, a front end, and a rear end, the main board having a flat middle area between the front end and the rear end;

a front bracket attached to the bottom surface of the main board near the front end of the main board;

a front axle attached to the front bracket;

a front pair of wheels rotatable about the front axle and comprising a first wheel and a second wheel, the first wheel and the second wheel of the front pair of wheels being attached to the front bracket;

a rear bracket attached to the bottom surface of the main board near the rear end of the main board;

a rear axle attached to the rear bracket;

a rear pair of wheels rotatable about the rear axle and comprising a first wheel and a second wheel, the first wheel and the second wheel of the rear pair of wheels being attached to the rear bracket;

a front track located on the middle of the bottom surface of the main board in the front half of the main board, the front track having a front set of teeth;

a rear track located on the bottom surface of the main board in the rear half of the main board, the rear track having a rear set of teeth;

a lower support bar having a front end, a rear end, a top surface, and a bottom surface, the front end of the lower support bar being attached to the front bracket, the rear end of the lower support bar being attached to the rear bracket;

a stopper block attached to the top surface of the lower support bar;

a central bracket located on the bottom surface of the main board;

a pair of V-frames comprising a front V-frame and a rear V-frame, each V-frame having a first end and a second end, the first end of each V-frame being connected to the central bracket, the second end of the front V-frame being connected to the front set of teeth, the second end of the rear V-frame being connected to the rear set of teeth;

a first roller wheel attached to the front V-frame halfway in between the first end and the second end of the front V-frame;

a second roller wheel attached to the rear V-frame halfway in between the first end and the second end of the rear V-frame;

a first spring attached between the first end and the second end of the front V-frame;

a second spring attached between the first end and the second end of the rear V-frame;

a front-toothed gear axially mounted on the front axle, the front toothed gear located adjacent to one of the wheels of the front pair of wheels;

a front lower support gear connected to the front-toothed gear;

a front upper support gear connected to the front lower support gear, the front upper support gear also connected to the front set of teeth;

a rear-toothed gear axially mounted on the rear axle, the rear-toothed gear located adjacent to one of the wheels of the rear pair of wheels; and a rear upper toothed gear attached to the rear-toothed gear, the rear upper toothed gear also connected to the rear set of teeth;

wherein each of the gears rotatable in a first direction and a second direction, the first direction and the second direction being opposite directions;

wherein placing downward pressure on the center of main board reduces the distance between the, main board and support bar causing the V-frames to expand;

wherein the V-frames force the front set of teeth outward toward the front end of the main board and the rear set of teeth outward toward the rear end of the main board, further the front set of teeth rotate the front upper support gear in the first direction which rotates the front lower support gear in the second direction which rotates the front-toothed gear in the first direction; and wherein the rear set of teeth rotates the rear upper toothed gear in the second direction which rotates the rear-toothed gear in the first direction, thereby propelling the skateboard in a forward manner.

2. A skateboard according to claim 1 wherein the front and the rear ends curve upward.

* * * * *